US007478989B2

(12) United States Patent
Ash

(10) Patent No.: US 7,478,989 B2
(45) Date of Patent: Jan. 20, 2009

(54) APPARATUS AND METHOD FOR VIBRATING A RAILCAR

(75) Inventor: Lloyd Ash, Pleasant Grove, UT (US)

(73) Assignee: Ashross, LLC, Pleasant Grove, UT (US)

( * ) Notice: Subject to any disclaimer, the term of this patent is extended or adjusted under 35 U.S.C. 154(b) by 38 days.

(21) Appl. No.: 11/811,737

(22) Filed: Jun. 11, 2007

(65) Prior Publication Data

US 2008/0003085 A1 Jan. 3, 2008

Related U.S. Application Data

(60) Provisional application No. 60/813,098, filed on Jun. 12, 2006.

(51) Int. Cl.
*B65G 67/00* (2006.01)

(52) U.S. Cl. ..... 414/375

(58) Field of Classification Search ..... 414/375, 414/363

See application file for complete search history.

(56) References Cited

U.S. PATENT DOCUMENTS

| | | | | | |
|---|---|---|---|---|---|
| 2,621,813 | A | * | 12/1952 | Bauerle et al. | 414/525.8 |
| 2,654,490 | A | * | 10/1953 | Glaze et al. | 414/572 |
| 2,673,651 | A | * | 3/1954 | Plant | 414/525.8 |
| 2,818,184 | A | * | 12/1957 | Matson | 414/375 |
| 3,047,169 | A | * | 7/1962 | Matson | 414/375 |
| 3,237,787 | A | | 3/1966 | Peterson | |
| 3,400,770 | A | * | 9/1968 | Matson | 173/32 |
| 4,068,768 | A | | 1/1978 | Hicks, Jr. | |
| 4,175,906 | A | | 11/1979 | Johnston et al. | |
| 4,224,006 | A | * | 9/1980 | Dumbaugh et al. | 414/375 |
| 4,307,989 | A | * | 12/1981 | Dumbaugh | 414/375 |
| 4,412,762 | A | | 11/1983 | Lepley et al. | |
| 4,522,500 | A | | 6/1985 | Hyer | |
| 5,433,523 | A | | 7/1995 | Grau | |
| 5,779,427 | A | * | 7/1998 | Heffinger | 414/375 |
| 6,058,588 | A | | 5/2000 | Wadensten | |
| 6,086,307 | A | | 7/2000 | Johanson | |
| 2006/0111029 | A1 | * | 5/2006 | Sim | 451/491 |

FOREIGN PATENT DOCUMENTS

| | | |
|---|---|---|
| WO | WO8203616 | 10/1982 |

OTHER PUBLICATIONS

Unload Railcars Fast and Efficiently with NAVCO Air Vibrators, www. navco.org.

* cited by examiner

*Primary Examiner*—Saúl J Rodríguez
*Assistant Examiner*—Joshua I Rudawitz
(74) *Attorney, Agent, or Firm*—Thorpe North & Western

(57) ABSTRACT

A railcar vibrator includes a base member and a vertical support coupled to the base member. A vibrator component is disposed on the vertical support. A wheel having a cushioned outer portion is rotationally coupled to the vertical support capable of rotation around an axis. The wheel can freely rotate, for riding along a moving railcar or line of railcars. A lateral positioning structure is operable with respect to the vertical support for adjusting the lateral position of the vertical support to place the cushioned outer surface of the wheel in contact with the railcar.

16 Claims, 5 Drawing Sheets

APPARATUS AND METHOD FOR VIBRATING A RAILCAR

PRIORITY CLAIM

The present application claims priority from U.S. Provisional Patent Application Ser. No. 60/813,098, filed on Jun. 12, 2006.

BACKGROUND

1. Field of the Invention

The present invention relates generally to railcar unloading devices. More particularly, the present invention relates to railcar vibrators.

2. Related Art

It is known that applying a vibrational force to a railway car or railway hopper car, hereafter referred to as a "railcar", can assist in unloading lading from a railcar hopper. Typical lading can include aggregate materials such as grain, sand, coal, petroleum coke, blast furnace coke, gravel, ballast, and a variety of other materials.

Applying a constant vibration to a railcar helps to reduce friction during discharge and to maintain a reliable flow of material, thus speeding up the unloading process. A large variety of vibrators have been developed to assist railway workers in vibrating railcars. These vibrators are typically attached to the side, top or bottom of a railcar. Some vibrators are portable vibrators that require being removed and replaced repeatedly to unload a line or railcars. Unfortunately, this process can be time-consuming and can require the use of several railway workers to repeatedly position and reposition the vibrators.

Other vibrators are larger, stationary vibrators that allow a line of railcars to be advanced into position, vibrated and unloaded, advanced again, vibrated and unloaded, and so on. While these vibrators avoid the need to manually reposition multiple portable vibrators, unfortunately these devices typically have a vibrator component that has to be retracted and then repositioned with each railcar, adding to the time required to unload a railcar. Moreover, sequencing errors such as advancing the railcar before the vibrator is retracted and cause damage to the vibrator, railcar, or both. Additionally, these devices are frequently expensive and bulky.

One important consideration in the technique of railcar unloading is the risk of damage to a railcar. Some railcar hoppers (typically older models) are made of steel. The steel siding of these hoppers can withstand the vibration of a vibrator having a powerful impact. However, many railcar hoppers are currently being made of more malleable materials, such as aluminum, composites, or the like. The sides of these cars can be easily damaged by the force of a powerful vibrator.

Noise pollution is another consideration involved with railcar unloading devices. Vibrators can be very noisy when used against a railcar hopper. This problem is compounded when multiple railcar vibrators are used, such as in a large railway station. This large volume of noise disturbs neighboring businesses and residents.

SUMMARY

Briefly, and in general terms, the invention is directed to a railcar vibrator having a base member and a vertical support that is coupled to the base member at the bottom end of the vertical support. A vibrator component is disposed on the vertical support. A wheel having a cushioned outer portion is rotationally coupled at the upper end of the vertical support so the wheel is capable of rotating around an axis. A lateral positioning structure that is operable with respect to the vertical support can adjust the lateral position of the vertical support to place the cushioned portion of the wheel in contact with the railcar.

Additional features and advantages of the invention will be apparent from the detailed description which follows, taken in conjunction with the accompanying drawings, which together illustrate, by way of example, features of the invention.

DETAILED DESCRIPTION

Figure 1:
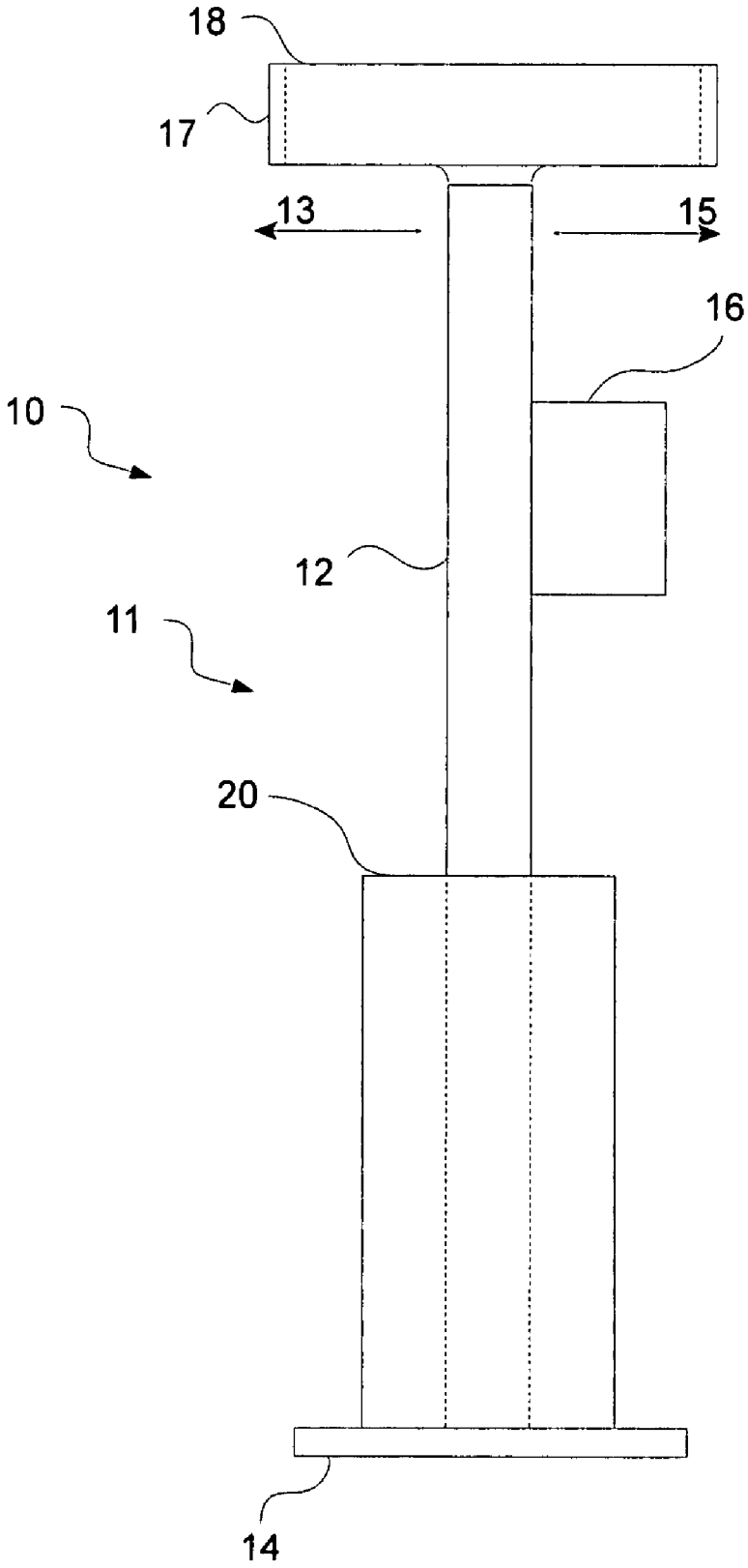
FIG. 1 is a side view of a railcar vibrator in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing and claiming the present invention, the following terminology will be used.

The singular forms "a," "an," and "the" include plural referents unless the context clearly dictates otherwise. Thus, for example, reference to "a vibrator component" includes reference to one or more of such vibrator components, and reference to "an airbag" includes reference to one or more of such airbags.

The term "lateral positioning structure" refers to an enclosure, supporting structure, or limiting structure used for controlling, limiting, supporting, and adjusting the lateral position of a moving vertical structure. For example, this lateral positioning structure can include a variety of control elements and devices to limit, control, adjust and support a vertical structure. These elements and devices can include, grooves, bumpers, airbags, adjustable limiting devices to adjustably limit the range of movement of the vertical structure, guide bars, and the like.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Measurements, distances, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 foot to about 5 feet" should be interpreted to include not only the explicitly recited values of about 1 foot to about 5 feet, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value and should apply regardless of the breadth of the range or the characteristics being described.

As used herein, the term "about" means that dimensions, sizes, formulations, parameters, shapes and other quantities and characteristics are not and need not be exact, but may be approximated and/or larger or smaller, as desired, reflecting tolerances, conversion factors, rounding off, measurement error and the like and other factors known to those of skill in the art.

As illustrated in FIG. 1, a vibrator device, shown generally at 10, is shown in accordance with an embodiment of the invention for use in shaking or vibrating a hopper type railcar 8 (FIGS. 3*a*-3*c*) in order to loosen lading, such as an aggregate material, within the hopper during discharge and emptying of the hopper. The vibrator device 10 can include a vertical support structure, shown generally at 11, for supporting a wheel 18. The vibrator device can also include a vibrator component 16 for vibrating or shaking the vertical support structure 11, and a lateral positioning structure for adjusting the lateral position of the vertical support means.

The vertical support structure 11 can include a base member 14 and a vertical support 12 coupled to the base member at the bottom portion 13 of the vertical support 12 for supporting the wheel within a substantially lateral plane with respect to a side of the railcar. The base member 14 can be of sufficient dimensions to support the vertical support 12 when in the vertical support is in motion. In one aspect, the vertical support can be pivotally coupled to a foundation surface, or the like. The vertical support structure 11 is one means for supporting the wheel 18.

The base member 14 can be a portable member or the base member can be fixed to the ground, foundation, platform, or other relatively flat surface in a static position. Suitable fasteners, such as cement screws, bolts, or other coupling devices can be employed to couple the base member in a fixed position. The base member 14 can be of sufficient dimensions so as to provide structural support to and prevent overturning of the railcar vibrator 10. Jacks 36 can be included to provide additional support and adjustability to the portable railcar vibrator 10.

The wheel 18 can have a cushioned outer portion 17 at a near constant height above the ground. The wheel can vibrate primarily in a direction towards 13 and away 15 from the railcar. The cushioned outer portion 17 of the wheel 18 can be rotationally coupled near a top portion of the vertical support 12. A layer of about 0.5 inches to about 4 inches of cushioned material can be coupled to the outer portion of the wheel 18 to form the cushioned outer surface 17. Advantageously, the cushioned outer surface 17 on the wheel 18 of the vibrator device 10 helps to mitigate the effects of and absorb the shock of the wheel's impact on the railcar, thus protecting the railcar from the potentially destructive effects of the blow. In contrast, a rigid wheel can cause damage to the railcar. This cushion material can also beneficially reduce the volume of noise produced by the impact of the wheel.

Wheels, rollers, tires and other wheel devices made of hardened or rigid metals, such as steel can be used by including a cushioned material on the outer surface. The cushioned material can be a layer of polyurethane, rubber, polytetrafluoroethylene (PTFE), synthetic flouropolymer such as Teflon®, wood, silicone, or other similar materials that will produce the a cushioned effect. Other cushioning materials as known in the art can also be used.

In a more detailed aspect, the wheel 18 and cushioned outer surface 17 can be a tire rim and rubber tire, such as a typical automobile pneumatic tire, or the like. A variety of tire sizes and forms can be used; however, it will be observed that firm tires having a high internal pressure may be more effective. A pneumatic tire can provide additional benefits to the railcar vibrator, such as low cost, easy availability, and adjustable cushioning based on the tire pressure.

When a pneumatic tire is employed with the invention, a hose connection or the like can be coupled to the pneumatic tire to control the internal pressure of the tire. Advantageously, by increasing the tire's internal pressure, the railcar vibrator 10 can contact a railcar with greater force. Similarly, by decreasing the internal pressure of the tire, the railcar vibrator can contact a railcar with a reduced force. Control of the pressure in the tire can be manual and/or electrical, and can include the use of automated controls.

To position the wheel 18 at a height suitable for typical railcars, the vertical support structure 11 can have a length of between about 6 feet to 12 feet. For example, in one aspect, the length could be about 8 feet. To accommodate for various railcar heights and ground levels the vertical support structure 11 can have a means for adjusting the height of the supported wheel 18. This means for adjusting the height can include telescoping members, a bolt adjusting means, replacement vertical supports of various sizes, and the like.

The railcar vibrator device 10 can further include a means for adjustably limiting the lateral displacement of the vibrating wheel 18 by controlling the lateral position with respect to the side of the railcar and lateral displacement of the vertical support 12 in the forward 13 and reverse 15 directions. The means for adjustably limiting lateral displacement can be configured to adjust the lateral position of the wheel in contact with the railcar. The means for adjustably limiting lateral displacement can include a lateral positioning structure 20. According to one detailed embodiment of the invention, the lateral positioning structure can include a pneumatic airbags 26 and 27 and one or more rubber bumpers 22. The function of the pneumatic airbags and rubber bumpers will be described in greater detail below. These components can be powered by hydraulic, electrical, and/or mechanical means.

A means for vibrating the wheel 18 can be connected to the vertical support. For example, the means for vibrating can include a vibrator component 16, such as one or more hydraulic, diesel, gas, electric, or pneumatic vibrators. As another example, the vibrator component 16 can include a motor driven crank and shaft for reciprocating the vertical support. It will be appreciated that the means for vibrating may include other configurations that may be apparent to one of skill in the art for moving the vertical structure in a reciprocating fashion.

Historically, a variety of vibrators have been applied to railcars to produce the necessary vibration for dislodging lading with the railcar. Vibrators are generally of at least two types: reciprocating type vibrators and rotating type vibrators. Reciprocating type vibrators reciprocate as mass back and forth in a linear motion, usually by means of a reciprocating piston. Rotating type vibrators rotate a mass in a circular or elliptical rotation, and result in a rotational, vector-type vibration. These vibrators are often called turbine or ball vibrators.

Advantageously, the vibrator device 10 of the present invention can use either type of vibrator as the vibrating component 16. Additionally, other vibrators could be used that produce eccentric or other forms of vibration. These various vibrator types can be powered by hydraulics, pneumatics, electricity, gas or diesel, and the like. The present invention can incorporate these various vibrator types according to the various unloading needs of the railcars.

The vibrator component 16 can vibrate at a variety of frequencies and can contact a railcar with a variable force, as previously mentioned. Numerous factors can be used to determine the desired frequency and force of the vibrator, including the type of lading, the type of railcar, moisture level of the lading, etc. The frequency of vibration can be controlled by increasing the volume of oil supplied to a hydraulic vibrator, increasing the RPMs of a vibrator, or other means known to those skilled in the art. Accordingly, one particular advantage of the railcar vibrator 10 is the ability to easily adjust the frequency and/or amplitude of vibration during operation, for example, for unloading different materials or accommodating different railcar types.

As illustrated in FIGS. 2*a*-3*c*, another railcar vibration device 100 is shown in accordance with another embodiment of the present invention. The railcar vibration device 100 can be similar in many respects to the vibration device 10 described above and shown in FIG. 1. The vibrator device 10 can include a vertical support structure, shown generally at 11, for supporting a wheel 18. The vibrator device can also include a vibrator component 16 for vibrating or shaking the vertical support structure 11, and a lateral positioning structure for adjusting the lateral position of the vertical support means.

Figure 2A:
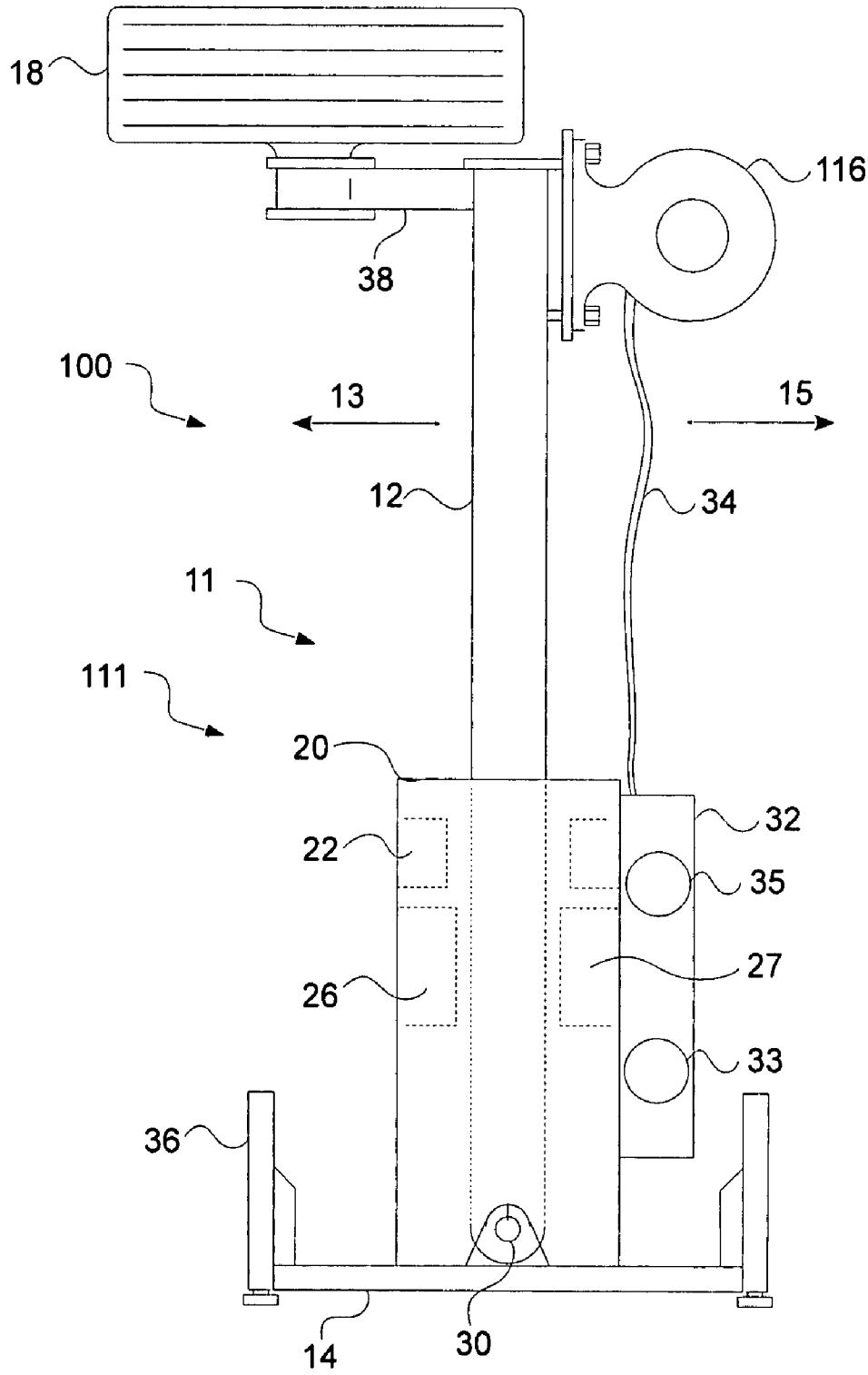
FIG. 2*a* is a side view of a railcar vibrator in accordance with another embodiment of the present invention.
Figure 2B:
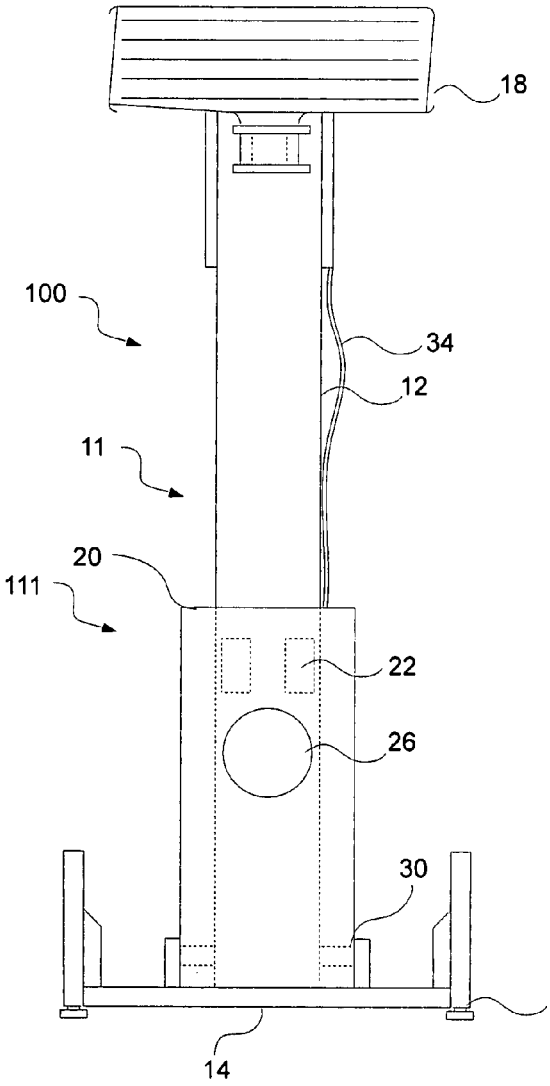
FIG. 2*b* is a front view of the railcar vibrator of FIG. 2*a;*
Figure 2C:
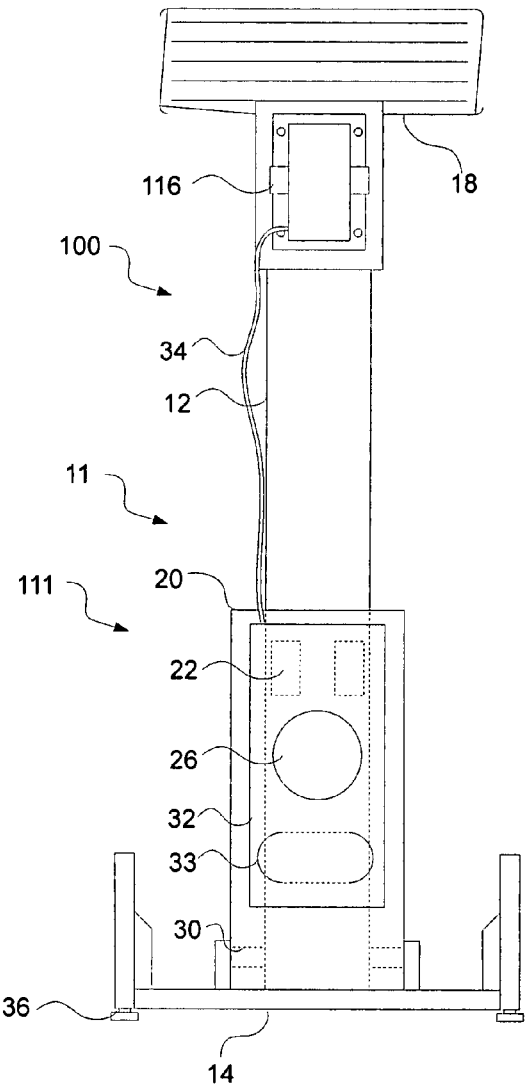
FIG. 2*c* is a rear view of the railcar vibrator of FIG. 2*a;*

Additionally, as shown in FIGS. 2*a*-2*c*, the vertical support structure 11 can include a partially-enclosed structure 111. This support structure can contain a portion of the vertical support 12, which can pivot about a pivotal coupling 30 in a substantially lateral plane towards and away from a railcar 8, as indicated by arrows 13 and 15.

Two pneumatic airbags 26 and 27 can be positioned on opposite sides of the vertical support 12. The pneumatic air bags 26 and 27 can control the two-directional, lateral positioning and displacement of the vertical support 12. These pneumatic airbags 26 and 27 can control the lateral positioning and lateral displacement of the vertical support 12 by inflating or pressurizing, and deflating or depressurizing one or both airbags, according to the desired movement or positioning of the vertical support 12.

It will be appreciated that various airbag configurations can be employed with the present invention. For example, air suspension airbags such as those used in automobile air suspension systems can be used according to one embodiment of the invention. These airbags 26 and 27 can be positioned horizontally to variably limit the lateral movement of the vertical support 12. These airbags can be pressurized to between about 60 psi to 100 psi. For example, in one aspect, the airbags can be pressurized to about 80 psi.

The airbags 26 and 27 can provide several advantages to the vibrator device 100 of the present invention. For example, one benefit of using airbags to limit the displacement of the vertical support is that the airbags can provide a low-impact suspension that can protect the components of the railcar vibrator from repeated impact and excess vibration. As another advantage, airbags also produce a low volume of noise, helping to reduce noise pollution.

Figure 3A:
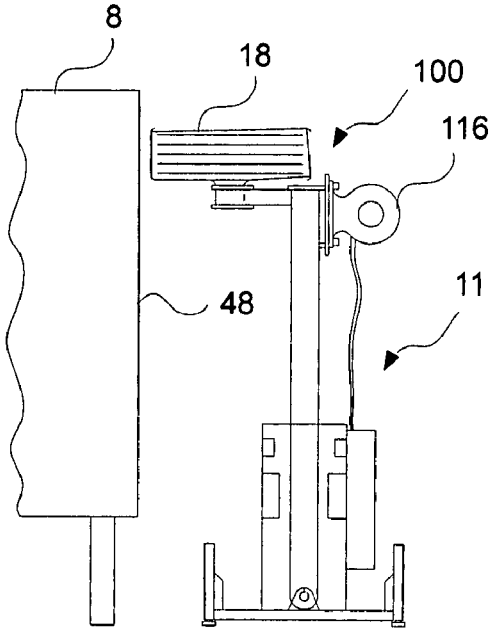
FIG. 3*a* is a side view of a the railcar vibrator of FIG. 2*a* in use with a railcar.
Figure 3B:
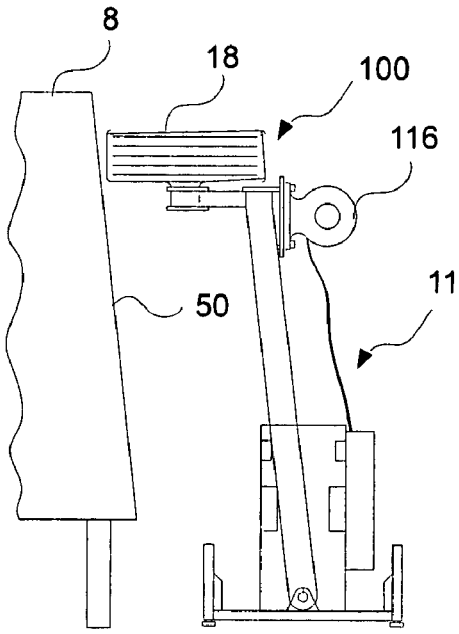
FIG. 3*b* is a side view of a the railcar vibrator of FIG. 2*a* in use with another railcar.
Figure 3C:
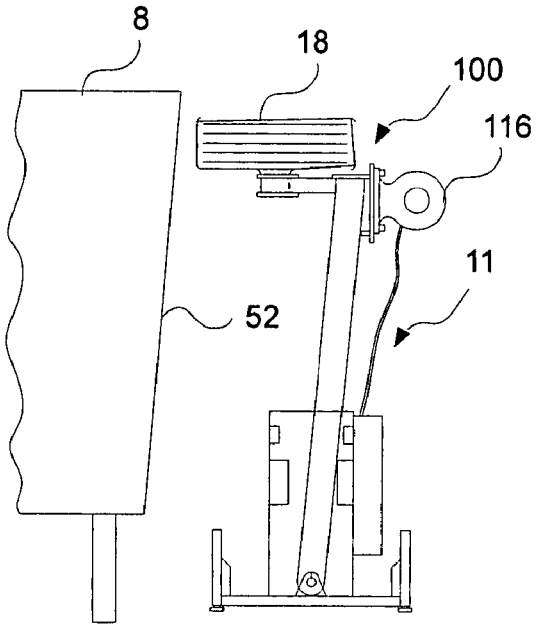
FIG. 3*c* is a side view of a the railcar vibrator of FIG. 2*a* in use with yet another railcar.

In use, the airbag 26 nearest to the railcar 8 can be slightly deflated to a desired pressure, while the airbag 27 on the opposite side can be slightly inflated in order to advance the cushioned portion of the wheel 18 (shown in FIG. 2*a*-3*c* as a pneumatic tire) towards the side of the railcar 8, as shown in FIG. 3*b*. By deflating one airbag and inflating the opposite airbag the position of the vertical support structure 11 can be shifted towards the direction of the railcar 8, while leaving the range of vibration nearly constant. Similarly, the airbag 26 nearest to the railcar 8 can be inflated slightly and the opposite airbag 27 can be deflated slightly to retract the cushioned portion of the wheel away from a railcar 8, as desired as shown in FIG. 3*c*. Additionally, when both airbags 26 and 27 are deflated the range of the lateral displacement of the vertical support 12 can be increased.

The inflation and deflation of the airbags 26 and 27 can be controlled by a set of valves (not shown) within the control panel 32. An air compressor 33 or other source of compressed air can also be included and connected to the control panel 32 from an outside location. If it is desired to fix the lateral displacement of the vertical support 12 to a fixed distance, the valves controlling the pressure of the airbags 26 and 27 can be interconnected so that when one airbag is being pressurized the other is simultaneously being depressurized. These valves can be controlled manually, or electronically.

In another aspect of the present invention, movable bumpers or stoppers, and/or the like can replace the pneumatic airbags. Additionally, to help avoid overturning the railcar vibrator device 100, the lateral displacement of the vertical support can be limited by one or more rubber bumpers 22, or an equivalent device. These rubber bumpers 22 can be positioned above or below the airbags 26 and 27 so as to prevent the vertical support 12 from tilting excessively in either a forward or a backward position.

In one aspect, a hydraulic rotary vibrator 116 can be used. This vibrator 116 can be coupled to an external hydraulic pump 35 via a power connection 34. The power connection 34 can couple the vibrator 116 to the control panel 34, or can be connected directly to an external power source (not shown). By adjusting the volume of hydraulic oil supplied to the vibrator 116 the frequency of the vibrator can be increased or decreased. This adjustment can simultaneously modify the amplitude or force or the vibrational stroke. The power source can also include an electrical connection, an air compressor, gas or diesel fuel, or a hydraulic pump. This power source can be contained within or without the control panel 32.

According to another embodiment of the invention the vibrator component 16 can include a plurality of vibrators (not shown). Rotary vibrators can create two-dimensional vibration, such as a forward-backward vibration as well as an upward-downward vibration. By employing two rotary vibrators that rotate in opposite directions, the upward-downward vibration can be substantially cancelled and the forward-backward vibration can be enhanced.

Referring to FIGS. 2*a* and 3*a*-3*c*, the vibrator component 16 can also be positioned near the top of the vertical support structure 11. A lateral extension 38 can be used to position the cushioned portion of the wheel 18 closer to a railcar 8. The lateral extension 38 can include telescoping members (not shown) to extend the wheel 18 to a variety of lateral distances from the side of the railcar 8. Additionally, the lateral extension can have a hinge (not shown) or other device for adjusting the direction and position of the wheel with respect to a ground surface, such as the rail bed, or rail tracks. Advantageously, this extended wheel position from the lateral extension 38 can be counterbalanced by the weight of the vibrator component 16 on the opposite side of the vertical support structure 11.

The lateral extension 38 can be made of a rigid material, such as metal, and can be between approximately 6 inches to 36 inches in length for a railcar vibrator 10 having a vertical support of approximately 8 feet. The lateral extension 38 can variably or rigidly position the wheel 18 closer to a railcar and reduce the lateral positioning range provided by the lateral positioning structure 20. Advantageously, a variable lateral extension, such as one that includes a telescoping or bolt adjusted extension, can allow the railcar vibrator 100 to be mounted at various distances from the railcar 8.

As described above, the railcar vibration device 100 can also include electronic controller 32. By incorporating electronic controls, the railcar vibrator 100 can be incorporated into an automated unloading system, wherein the frequency and pressure of the vibration can be automatically adjusted based on various measurements and inputs of the automated unloading system. For example, moisture sensors can sense high or low moisture levels of the lading and modify the vibrating characteristics of the vibrator 16 accordingly.

Additionally, scales, temperature sensors, and lading type information can be used to adjust the vibrator configuration according to pre-programmed configurations. For example, if a railcar scale indicated to an external processor that the weight of the railcar had not changed for a predetermined amount of time, such as ten minutes, the processor could interpret this to mean that the railcar unloading orifice was clogged. In response to this interpretation the processor could signal to the railcar vibrator to begin a preprogrammed "unclogging" configuration, wherein the railcar vibrator 100 could increase, decrease, or vary the frequency of vibration in an effort to remove the clogged lading.

An additional advantage of the present invention is that the railcar vibration device 100 can sequentially vibrate a plurality of consecutive railcars from a similar or fixed position without the need for repositioning, as shown in FIGS. 3*a*-3*c*. In contrast, systems that require repositioning with every railcar consume time and resources during the repositioning steps thereby increasing costs and decreasing efficiency of unloading systems.

Thus, with respect to the embodiments of the railcar vibrating device discussed herein, once the railcar vibrator 10 or 100 is positioned along side a railcar the railcar can advance forward or backward, while the wheel 18 rotates and/or rolls along the railcar or along a line of railcars. For example, as shown in FIG. 3*a*, the railcar vibrator 100 can roll along a railcar of standard width 48, while vibrating the railcar. When the railcar passes, the wheel 18 will fall as far forward as the lateral positioning structure 20 will allow. This distance can range from between about 2 inches to about 18 inches, depending on the initial position of the vertical support 12. When another railcar advances, the vertical support structure 11 will be picked up again, as the wheel 18 rolls along the edge or side of the railcar. When a railcar comes along having a narrow width 50, as shown in FIG. 3*b*, the railcar vibrator device 100 can fall forward and automatically adjust for this lateral difference between the cars. Likewise, when a railcar comes along having a larger width 52, as shown in FIG. 3*c*, the railcar vibrator device 100 can be pushed backwards to automatically adjust for the decreased lateral distance.

In this way, positioning abilities of the lateral positioning structure provide several advantages to the railcar vibrating device 100. For example, the adjustments to the positioning of the wheel due to differences in railcar width can be made while the railcar vibrator is vibrating. Additionally, these adjustments can be further aided by manual or automatic reconfigurations to the lateral positioning structure 120 and airbags 26 and 27. This ability to self-adjust to lateral contours can allow the wheel 18 to effectively roll along the side of a ribbed railcar and railcars having non-uniform siding. Because this ability to automatically move from railcar to railcar does not require manual repositioning, cost and time required to unload a railcar and/or line of railcars can be dramatically decreased.

Figure 4:
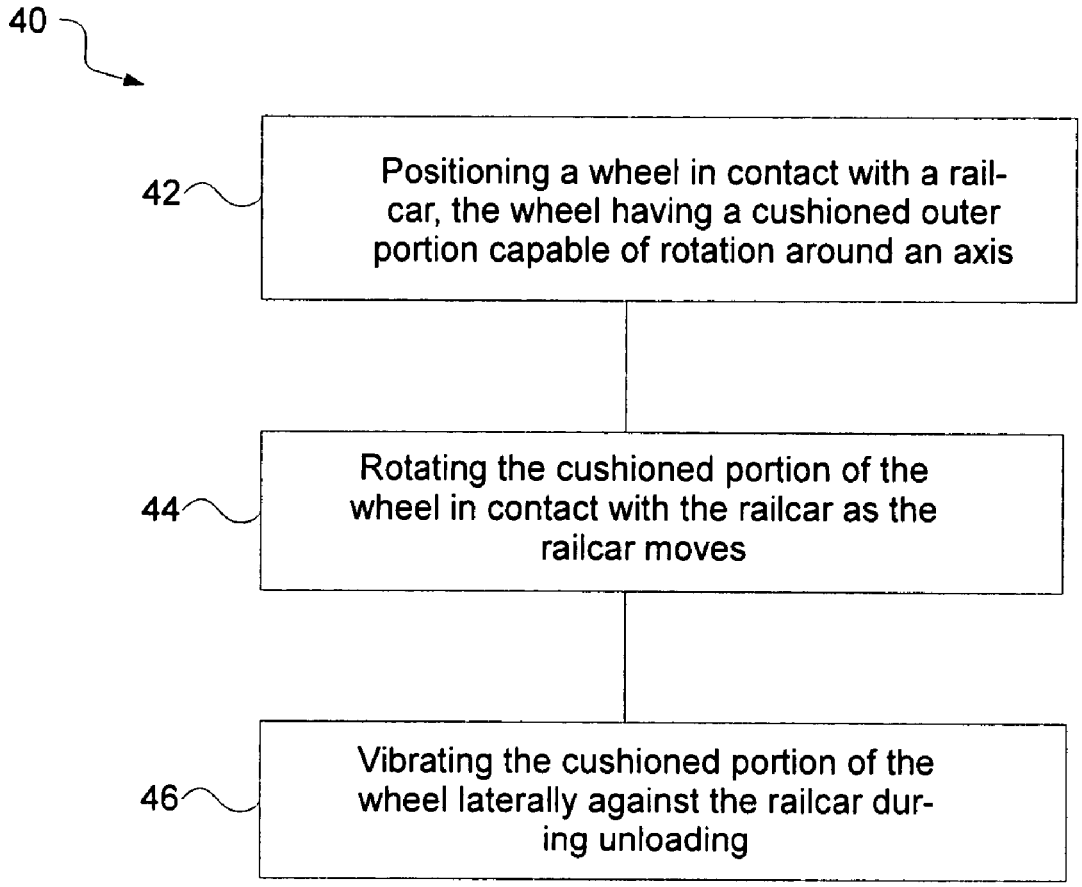
FIG. 4 is a flowchart of a method of vibrating a railcar.

The present invention also provides for a method of vibrating a rail car, as shown in FIG. 4, in accordance with an embodiment of the present invention. The method 40 includes positioning 42 the wheel 18 near a railcar. As described above, positioning the wheel can be performed by a means for adjustably limiting lateral displacement of the vibrating wheel substantially within a lateral plane, such as with the lateral positioning structure 20 shown in FIGS. 2*a*-2*c*.

The method 40 also includes rotating the wheel 18 in contact with the railcar, as shown at 44. This step involves positioning the wheel near or in contact with the railcar. The motion of the railcar can rotate the wheel 18 around an axis. The rotation of the wheel can absorb at least a portion of the horizontal force of the railcar caused by ribs, and other non-planar contours along a railcar. This rotation can further increase the ease with which the wheel 18 navigates over bumps and ridges as it moves along a railcar. Because the wheel will not be in constant contact with the car, the wheel can maneuver over and around ribs and other non-planar railcar surfaces, including the front and back sides.

The method 40 also includes vibrating the wheel against the railcar during unloading of the railcar hopper, as shown at 46. This vibration can originate from the means for vibrating the pneumatic wheel against a railcar, such as the vibrator component 16 shown in FIGS. 2*a*-2*c*. This vibration can help to reduce the friction and maintain a reliable flow of contained material during the unloading process.

The method 40 can further include adjusting various components and properties of the railcar vibrator 10. One property that can be adjusted is the frequency of vibration. The vibrational frequency determines how many times the wheel 18 reciprocates back and forth within a given period of time. By increasing the frequency, the wheel contacts the railcar a larger number of times per unit of time. It will be appreciated that various types of lading can respond differently to different vibrational frequencies. By knowing the type of lading, and optimal frequency of vibration for the size and density of the material, the railcar vibrator device 100 can be adjusted to adapt to a given load.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A vibrator device for vibrating a railcar, the vibrator comprising:

a) a base member;

b) a vertical support having a top end, and a bottom end coupled to the base member;

c) a wheel having a cushioned outer portion, rotationally coupled at an upper end of the vertical support and capable of rotation around an axis;

d) a vibrator component coupled to the vertical support;

e) a lateral positioning structure operable with respect to the vertical support to adjust the lateral position of the vertical support to place the cushioned outer portion of the wheel in contact with the railcar; and f) the lateral position structure further includes a pair of pneumatic airbags, operably disposed on opposite sides of the vertical support, the pneumatic airbags being operable to control the lateral position of the cushioned outer portion of the wheel with respect to sidewall of an adjacent railcar.

2. The device of claim 1, wherein the cushioned outer portion comprises a tire.

3. The device of claim 1, wherein the wheel comprises a metal wheel and the cushioned outer portion is a layer of resilient material.

4. The device of claim 3, wherein the resilient material is selected from a group consisting of a layer of polyurethane, polytetrafluoroethylene (PTFE), synthetic flouropolymer, rubber, silicon, wood, and combinations thereof.

5. The device of claim 1, wherein the bottom end of the vertical support is pivotally coupled to the base member.

6. The device of claim 1, wherein the lateral positioning structure further includes a control panel coupled to the pneumatic airbags to control the displacement of the pneumatic airbags.

7. The device of claim 1, wherein the lateral positioning structure further includes an air compressor to provide pressure to the pneumatic airbags.

8. The device of claim 1, wherein the lateral positioning structure further includes rubber bumpers to limit the lateral displacement of the vertical support within a safe range of inclination.

9. The device of claim 1, wherein the vertical support includes a lateral extension, having a proximal end coupled near the top end of the vertical support, and a distal end positioned near the wheel so as to position the wheel near the railcar.

10. The device of claim 1, wherein the vibrator component further includes at least one hydraulic vibrator.

11. The device of claim 1, further including a power source coupled to the vibrator component.

12. The device of claim 11, wherein the power source is selected from the group consisting of an air compressor, a hydraulic pump, a gas or diesel fuel source, and an electricity source.

13. A method of vibrating a railcar, without regard to order, the method comprising:

a) positioning a wheel in contact with the railcar by actuating a pair of pneumatic airbags disposed on opposite sides of a vertical support coupled to the wheel to laterally move the vertical support and the wheel with respect to the railcar, the wheel having a cushioned outer portion capable of rotation around an axis;

b) rotating the cushioned portion of the wheel in contact with the railcar as the railcar moves; and c) vibrating the wheel laterally against the railcar during unloading.

14. The method of claim 13, wherein the step of vibrating further includes adjusting frequency of vibration.

15. The method of claim 13, wherein the step of vibrating further includes adjusting pressure of a vibrating stroke.

16. The method of claim 15, wherein the step of adjusting the pressure includes adjusting the speed of the vibrator.

* * * * *